US006321458B1

(12) United States Patent
Hess

(10) Patent No.: US 6,321,458 B1
(45) Date of Patent: Nov. 27, 2001

(54) QUILTING TEMPLATE METHODS AND APPARATUS

(75) Inventor: Katherine L. Hess, 615 Augusta, Moraga, CA (US) 94556

(73) Assignee: Katherine L. Hess, Moraga, CA (US)

( * ) Notice: Subject to any disclaimer, the term of this patent is extended or adjusted under 35 U.S.C. 154(b) by 0 days.

(21) Appl. No.: 09/483,288

(22) Filed: Jan. 14, 2000

(51) Int. Cl.[7] ..... A41H 3/01
(52) U.S. Cl. ..... 33/566; 33/12; 33/17 A
(58) Field of Search ..... 33/566, 1 F, 1 G, 33/11, 12, 13, 17 R, 17 A, 562, 563, 565

(56) References Cited

U.S. PATENT DOCUMENTS 1,879,624 * 9/1932 Lockwood ..... 33/563
2,188,310 * 1/1940 Price ..... 33/11
2,657,159 * 10/1953 Nahman ..... 33/12
2,760,202 * 8/1956 Ethe ..... 33/12
3,257,727 * 6/1966 Berlin ..... 33/12
4,053,986 * 10/1977 Axelrod ..... 33/12
4,057,898 * 11/1977 Piosky ..... 33/563
4,210,041 * 7/1980 Mitman et al. ..... 33/11
4,675,253 * 6/1987 Bowditch ..... 33/17 A
4,912,850 * 4/1990 Gray ..... 33/1 G
4,945,642 * 8/1990 Saulietis ..... 33/12

* cited by examiner

*Primary Examiner*—Christopher W. Fulton
(74) *Attorney, Agent, or Firm*—Fish & Richardson P.C.

(57) ABSTRACT

A quilting template methods and apparatus are described. An exemplary quilting template apparatus includes a panel having a plurality of pattern pieces of a similar shape and size. Each pattern piece includes a first and a second plurality of slots disposed through the panel. Each slot is a guide for a marking device to apply a mark on a surface of a fabric along the respective slot. The panel has a fabric contacting surface and an opposite facing non-fabric contacting surface. A pictorial representation of a quilt design and a color scheme for the quilt design can be printed on the non-fabric contacting surface of the panel.

25 Claims, 3 Drawing Sheets

QUILTING TEMPLATE METHODS AND APPARATUS

BACKGROUND OF THE INVENTION

The present invention is related to quilting template methods and apparatus for use in transferring multiple pattern pieces of a quilt design to fabric.

Typically, a user uses a marking device to transfer a pattern piece from a quilting template to fabric. The pattern piece can include cutting lines and stitching lines. Once the pattern piece is transferred to the fabric, the user can use a cutting device to cut along the cutting lines to form the fabric piece desired. The user repeats this process until the desired number of fabric pieces have been formed. If a particular quilt design requires fabric pieces of different shapes, the user can repeat the process using different quilting templates.

Current quilting templates provide numerous apparatus for use in transferring one or more pattern pieces to fabric. One quilting template is manufactured in a pattern piece shape, so that when a user moves a cutting device around the outside of the template, the desired fabric shape is formed. Another quilting template includes multiple pattern pieces each having a distinct shape. Both of the quilting templates have one pattern piece per pattern piece shape. Using these quilting templates to transfer multiple pattern pieces of the same pattern piece shape to fabric can be time-consuming, as the user has to reposition the quilting template for each pattern piece transfer.

SUMMARY OF THE INVENTION

In one aspect, the invention features a quilting template apparatus comprising a panel having a fabric contacting surface and an opposite facing non-fabric contacting surface. The quilting template apparatus has a plurality of pattern pieces of a similar shape and size, where each pattern piece includes a first and a second plurality of slots disposed through the panel. Each slot is a guide for a marking device to apply a mark on a surface of a fabric along the respective slot.

Embodiments may include one or more of the following features.

The plurality of pattern pieces may have an identical shape and size. The panel may be formed from a substantially rigid material. The first plurality of slots may completely enclose the second plurality of slots. The first plurality of slots may define cutting slots and the second plurality of slots may define stitching slots. A pictorial representation of a quilt design associated with the panel may be printed on the non-fabric contacting surface. The quilt design may be a quilt block design or a quilt border design. A color scheme for the quilt design may also be printed on the non-fabric contacting surface.

In another aspect, the invention features a method of transferring pattern pieces of a quilt design to fabric using a panel having a plurality of pattern pieces of a similar shape and size. Each pattern piece comprises a first and a second plurality of slots disposed through the respective panel. The method comprises placing at least one panel on a layer of fabric, and using a marking device to apply a mark on the layer of fabric along each slot.

Embodiments may include one or more of the following features.

The quilt design may be a quilt block design. The quilt design may be a quilt border design. Cutting lines may be formed corresponding to the marks applied along the first plurality of slots. Stitching lines may be formed corresponding to the marks applied along the second plurality of slots. The layer of fabric may be cut on the cutting lines to form respective fabric pieces. The fabric pieces may be stitched on the stitching lines in a particular configuration to assemble a quilt block. The fabric pieces may be stitched on the stitching lines in a particular configuration to assemble a quilt border.

In another aspect, the invention features a method of manufacturing an apparatus for transferring pattern pieces of a quilt design to fabric. The method comprises forming a first and a second plurality of slots through a panel for each of a plurality of pattern pieces of a similar shape and size and printing a pictorial representation of the quilt design on the panel. The quilt design may be a quilt block design. The quilt design may be a quilt border design. The panel may be formed from a substantially rigid material. The first plurality of slots may completely enclose the second plurality of slots.

Advantages that can be seen in implementations of the invention include one or more of the following. The invention enables multiple pattern pieces to be marked on a piece of fabric with the use of a single panel. This minimizes the layout time of the pattern pieces on the fabric while efficiently using the piece of fabric being cut.

The details of one or more embodiments of the invention are set forth in the accompanying drawings and the description below. Other features and advantages of the invention will become apparent from the following description, including the drawings and the claims.

BRIEF DESCRIPTION OF THE DRAWINGS

Like reference numbers and designations in the various drawings indicate like elements.

DETAILED DESCRIPTION

Figure 1:
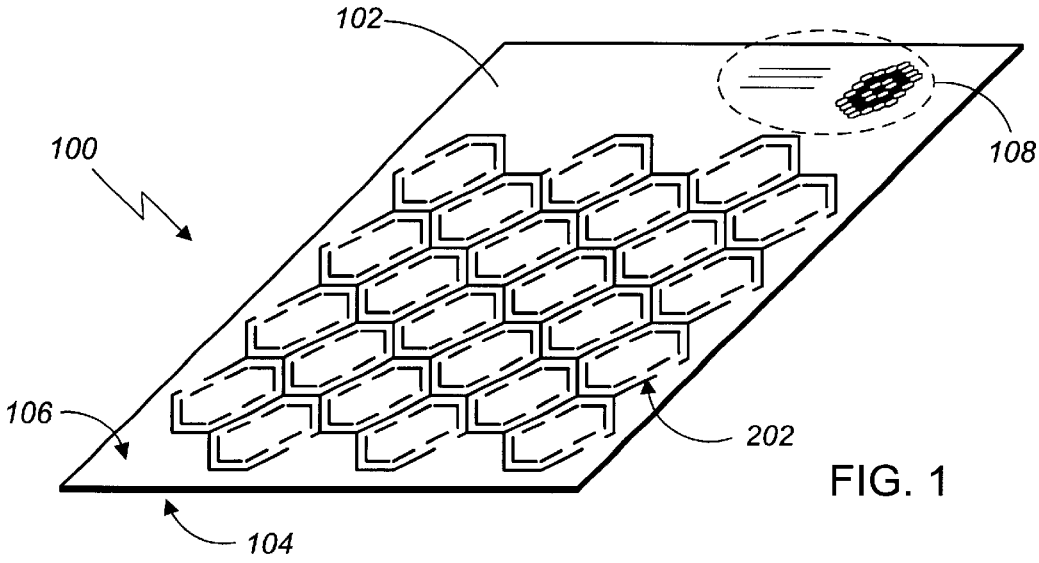
FIG. 1 is a diagrammatic perspective view of one embodiment of a quilting template apparatus in accordance with the present invention.

FIG. 1 shows a quilting template apparatus 100 which includes a panel 102 having a fabric contacting surface 104 and an opposite facing non-fabric contacting surface 106. The panel 102 may be formed from a substantially rigid material such as a plastic. In one implementation, the panel

102 may be formed from a transparent plastic to enable a user to view the design on a fabric to be marked and position the panel 102 to include a particular design on the fabric. In another implementation, friction between the panel 102 and the fabric may be increased by roughening the fabric contacting surface 104 to prevent sliding of the panel 102 when marks are being applied to the fabric.

Figure 4A:
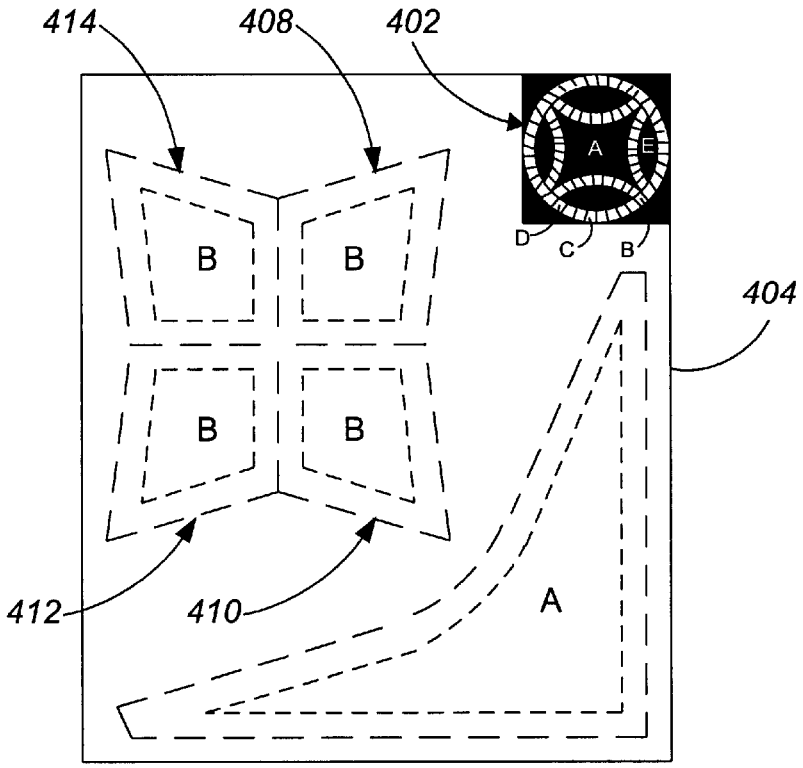
FIGS. 4*a* and 4*b* are diagrammatic views of another embodiment of a quilting template apparatus in accordance with the present invention.

In one implementation, the panel 102 can include pattern pieces of a similar (or identical) shape and size. For example, multiple pattern pieces 202 (see also FIG. 2*a*) of a single pattern piece shape 204 (FIG. 2*b*) can be formed on the panel 102. Each pattern piece may be a block piece, for example, block piece 204 in FIG. 2*b*, or a border piece (not shown). Each pattern piece may have the same orientation on the panel 102 (FIG. 1); each pattern piece may have a different orientation on the panel 102 (FIG. 4*a*). In the example shown in FIG. 4*a*, the pattern pieces 408, 410 and 412 are rotated versions of the pattern piece 414. In another implementation, the panel 102 can include pattern pieces of different shapes and sizes. Referring to FIG, 4*b*, multiple pattern pieces 416 of pattern piece shape C 420 and multiple pattern pieces 422 of pattern piece shape D 418, can be formed on the panel 406, for example.

Figure 2A:
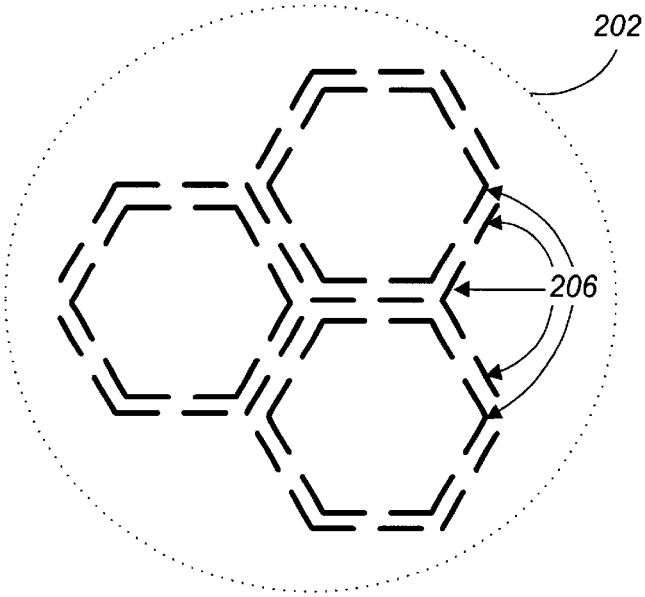
FIG. 2*a* is an enlargement of multiple pattern pieces shown in FIG. 1.
Figure 2B:
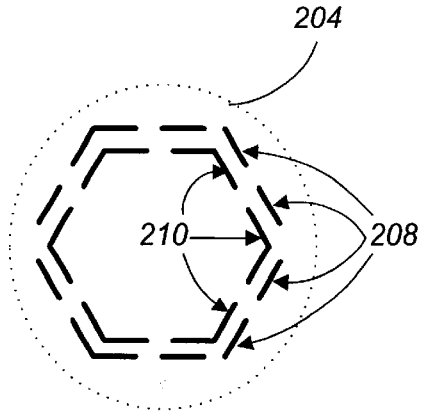
FIG. 2*b* is an enlargement of a single pattern piece shape shown in FIG. 1.

Referring to FIGS. 2*a* and 2*b*, each pattern piece 204 has a first and a second plurality of slots disposed through the panel 102. Each slot 206 is a long, narrow aperture extending completely through the panel 102. Each slot 206 is a guide for a marking device such as a pencil or a pen that can be used to apply a mark on the fabric along the slot. The first plurality of slots may be defined as cutting slots 208 and the second plurality of slots may be defined as stitching slots 210. The cutting slots 208 (outside lines) of each pattern piece completely enclose the stitching slots 210 (inside lines) of the pattern piece. In one implementation, the panel 102 may be fabricated such that the lengths of each of the cutting slots 208 is greater than that of the stitching slots 210 to provide the user with a visual aid to distinguish a cutting line from a stitching line once the marks are applied along the cutting slots 208 and stitching slots 210, respectively.

Figure 3A:
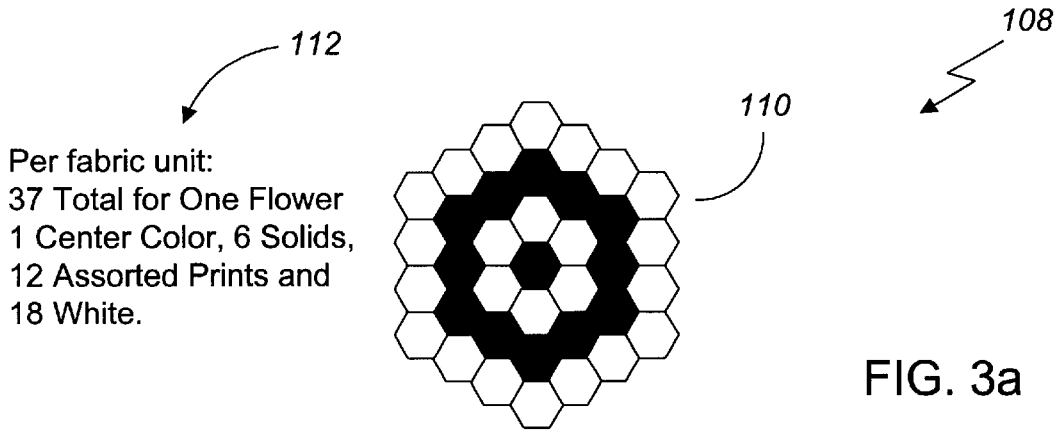
FIG. 3*a* is an enlargement of a pictorial representation and a color scheme for the quilt design shown in FIG. 1.
Figure 3B:
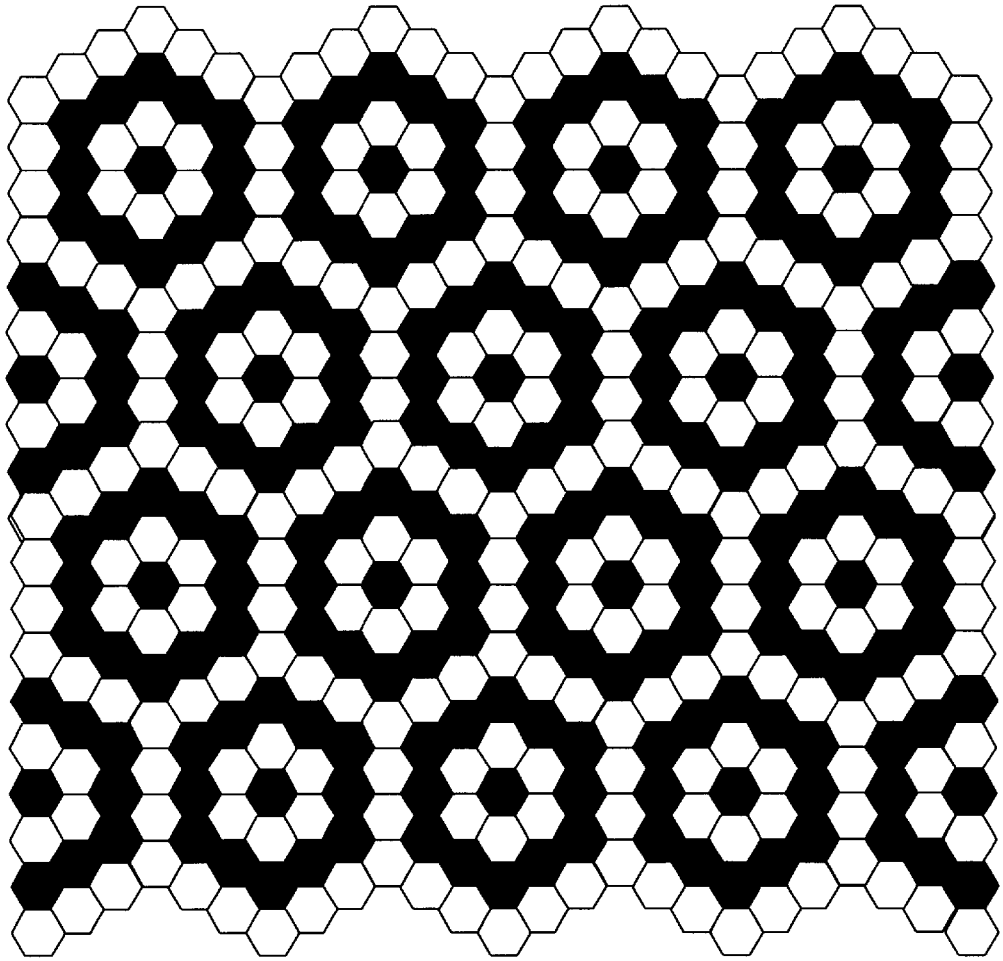
FIG. 3*b* is an end product assembled using multiple fabric units.

A user can use a cutting device, such as a rotary cutter or a pair of scissors, to cut the fabric on the cutting lines marked. The cut-out fabric pieces may be stitched together by hand or machine on the stitching lines marked in a configuration corresponding to a quilt design 108 associated with the panel 102. In one implementation, a pictorial representation of the quilt design 108 associated with the panel 102 is printed on the non-fabric contacting surface 106, as shown in FIG. 1. The quilt design 108 may be a quilt block design 110 (FIG. 3*a*) or a quilt border design (not shown). A suggested color scheme 112 for the quilt design may also be printed on the non-fabric contacting surface 106. Once the user has stitched together all of the fabric pieces according to the quilt design, a fabric unit is formed. The fabric unit may be an end product, such as a quilt. Alternatively, the fabric unit may be a subset of an end product. For example, multiple fabric units may be stitched together to form the end product, as shown in FIG. 3*b*.

Figure 4B:
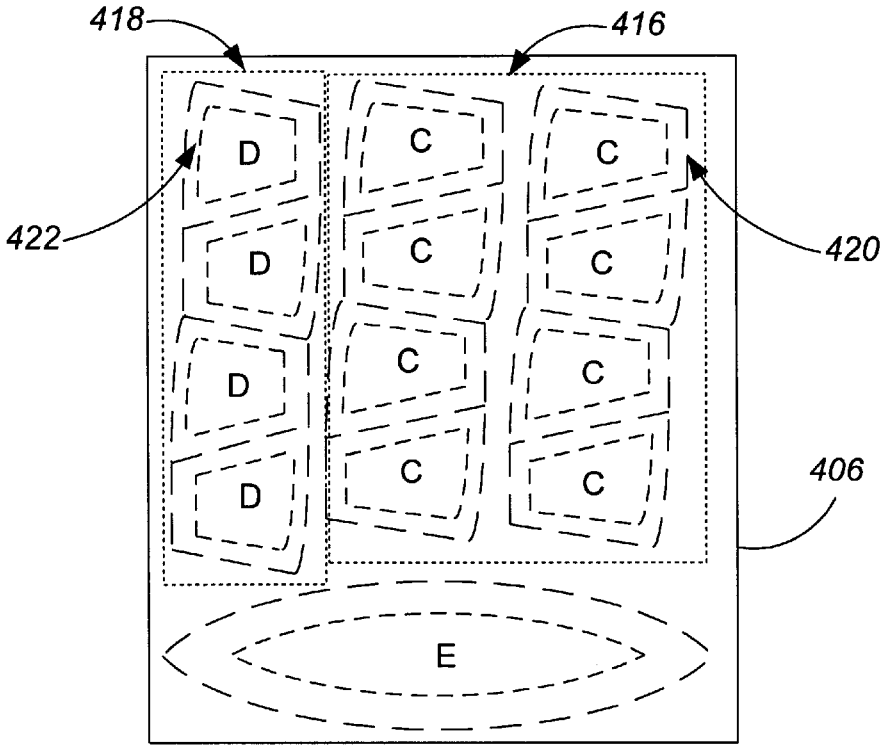

The invention has been described in terms of particular embodiments. Other embodiments are within the scope of the following claims. For example, a single panel may include all the pattern piece shapes needed for a particular quilt design. For another quilt design, multiple panels may be needed. For example, FIGS. 4*a* and 4*b* show a quilt design 402 that can be assembled by stitching together multiple fabric pieces, each formed by transferring one of the five pattern piece shapes, respectively labeled A, B, C, D and E to fabric. In this example, one panel 404 contains the pattern pieces for the pattern piece shapes A and B, and another panel 406 contains the pattern pieces for the pattern piece shapes C, D and E. The steps of the invention can be performed in a different order and still achieve desirable results.

What is claimed is:

1. An apparatus, comprising:

a panel having a fabric contacting surface and an opposite facing non-fabric contacting surface; and a plurality of pattern pieces of a quilt design, each pattern piece having a shape and size, and including a first and a second plurality of slots disposed through the panel, wherein each slot is a guide for a marking device to apply a mark on a surface of a fabric along the respective slot.

2. The apparatus of claim 1, further comprising a plurality of pattern pieces of an identical shape and size.

3. The apparatus of claim 1, further including printing on the non-fabric contacting surface of the panel, a pictorial representation of a quilt block design.

4. The apparatus of claim 1, further including printing on the non-fabric contacting surface of the panel, a color scheme for a quilt block design.

5. The apparatus of claim 1, further including printing on the non-fabric contacting surface of the panel, a pictorial representation of a quilt border design.

6. The apparatus of claim 1, further including printing on the non-fabric contacting surface of the panel, a color scheme for a quilt border design.

7. The apparatus of claim 1, wherein the panel is formed from a substantially rigid material.

8. The apparatus of claim 1, wherein the first plurality of slots completely encloses the second plurality of slots.

9. The apparatus of claim 1, wherein:

the first plurality of slots define cutting slots; and the second plurality of slots define stitching slots.

10. The apparatus of claim 1, further comprising a plurality of pattern pieces of a similar shape and size.

11. A method of transferring pattern pieces of a quilt design to fabric, comprising:

placing at least one panel on a layer of fabric, each panel comprising a plurality of pattern pieces, each pattern piece having a shape and size, and including a first and a second plurality of slots disposed through the respective panel; and using a marking device to apply a mark on the layer of fabric along each slot.

12. The method of claim 11, wherein the pattern pieces are used to form a quilt block design.

13. The method of claim 11, wherein the pattern pieces are used to form a quilt border design.

14. The method of claim 11, wherein:

cutting lines are formed corresponding to the marks applied along the first plurality of slots; and stitching lines are formed corresponding to the marks applied along the second plurality of slots.

15. The method of claim 14, further comprising:

cutting the layer of fabric on the cutting lines to form respective fabric pieces; and stitching a configuration of fabric pieces on the stitching lines to assemble the quilt block.

16. The method of claim 14, further comprising:

cutting the layer of fabric on the cutting lines to form respective fabric pieces; and stitching a configuration of fabric pieces on the stitching lines to assemble the quilt border.

17. The method of claim 11, wherein the pattern pieces have a similar shape and size.

18. The method of claim 11, wherein the pattern pieces have an identical shape and size.

19. The method of manufacturing an apparatus for transferring pattern pieces of a quilt design to fabric, comprising:

forming a first and a second plurality of slots through a panel for each of a plurality of pattern pieces, each having a shape and size; and printing on the panel a pictorial representation of the quilt design.

20. The method of claim 19, wherein the pattern pieces are used to form a quilt block design.

21. The method of claim 19, wherein the pattern pieces are used to form a quilt border design.

22. The method of claim 19, further comprising: using a panel formed from a substantially rigid material.

23. The method of claim 19, further comprising: forming the first plurality of slots to completely enclose the second plurality of slots.

24. The method of claim 19, wherein the first and second plurality of slots are formed for a plurality of pattern pieces have a similar shape and size.

25. The method of claim 19, wherein the first and second plurality of slots are formed for a plurality of pattern pieces have an identical shape and size.

* * * * *